United States Patent [19]

Daussan et al.

[11] 4,339,115

[45] Jul. 13, 1982

[54] HEAT INSULATING LINING FOR METALLURGICAL VESSELS

[75] Inventors: Jean-Charles Daussan; Gérard Daussan, both of Metz; Andre Daussan, Longeville les Metz, all of France

[73] Assignee: Daussan et Compagnie, Woippy, France

[21] Appl. No.: 130,175

[22] Filed: Mar. 11, 1980

[30] Foreign Application Priority Data

Mar. 22, 1979 [FR] France ..... 79 07287

[51] Int. Cl.[3] ..... C21B 7/04

[52] U.S. Cl. ..... 266/280

[58] Field of Search ..... 266/280

[56] References Cited

U.S. PATENT DOCUMENTS 3,345,059 10/1967 Swindt ..... 266/280
4,014,531 3/1977 Takashima ..... 266/280
4,076,224 2/1978 Duchateau ..... 266/280
4,120,641 10/1978 Myles ..... 266/280

FOREIGN PATENT DOCUMENTS 977124 11/1975 Canada ..... 266/280

*Primary Examiner*—P. D. Rosenberg
*Attorney, Agent, or Firm*—Young & Thompson

[57] ABSTRACT

The heat insulating lining of the metallurgical vessel includes a permanent layer in a refractory material and a consumable layer arranged in the interior of the vessel and intended to be in direct contact with the liquid metal. This layer consists of a mixture of inorganic particles and of mineral and/or organic fibers embedded in an organic and/or inorganic binder. Between the permanent layer and the consumable layer is fitted a relatively compressible layer of an inorganic and/or organic fibre base resistant to the temperature pertaining at the contact of the consumable layer, these fibres being partially embedded in an organic and/or inorganic binder.

9 Claims, 7 Drawing Figures

HEAT INSULATING LINING FOR METALLURGICAL VESSELS

Figure 1:
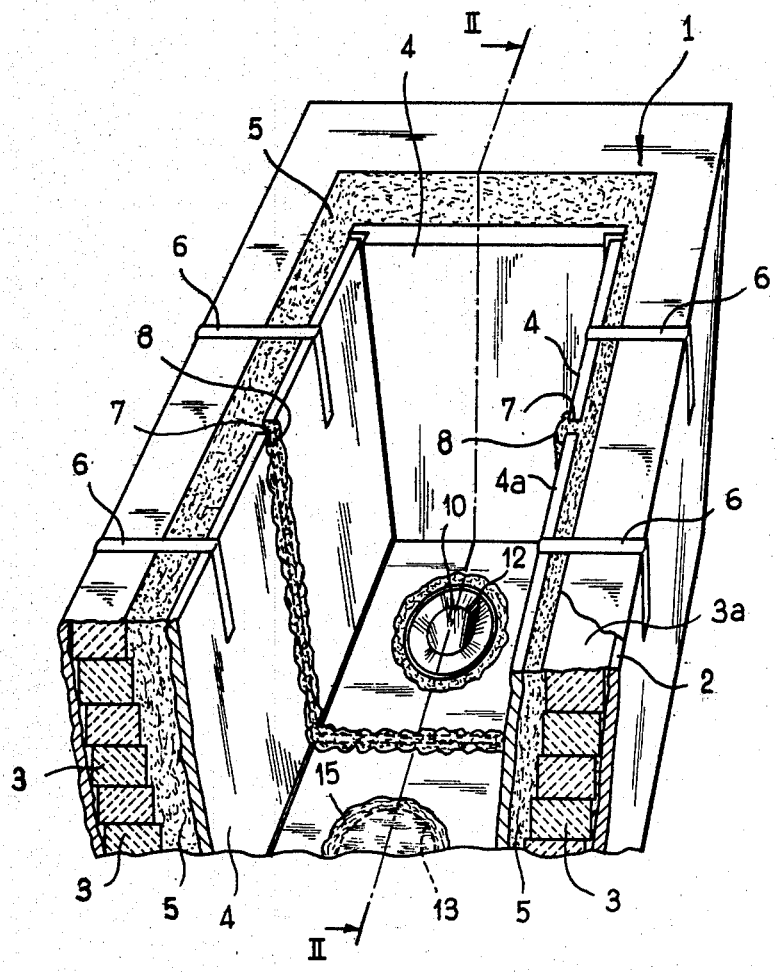

This invention concerns a heat insulating lining for metallurgical vessels intended to contain liquid metal and in particular cast iron or steel.

The invention applies preferably to metallurgical vessels known as tundishes situated under a casting ladle containing liquid metal, and intended to divide the liquid metal between ingot moulds.

The interior lining of such tundishes consists of a layer of refractory bricks applied to the inside face of the outside metal envelope of the tundish.

In a recent development the layer of refractory bricks which will hereinafter be referred to as "permanent refractory layer", is covered by a layer made up of a series of relatively rigid plates, removable and substantially joined together.

These plates consist of a mixture of inorganic particles such as sand and/or alumina and of organic and/or inorganic fibres embedded in an organic binder such as a phenolic resin, or an inorganic one such as a refractory cement.

Such plates protect the permanent refractory layer against abrasion from the metal, avoid the solid metal adhering to this layer, and subsequently, facilitate the cleaning of the tundish at the end of the casting. Furthermore, these plates considerably improve the heat insulation of the walls of the tundish, thus avoiding, in particular, a long and expensive preheating of the tundishes before the introduction of the molten metal.

These heat insulating plates are consumable, that is to say they wear out relatively quickly. Generally they stand up to only one casting operation. This disadvantage is however amply compensated by the numerous advantages which they bring and, notably, their low cost, and the ease with which they can be replaced at the end of the casting.

The use of these consumable plates is nevertheless not entirely satisfactory, because it is impossible to joint them correctly, due in particular to the irregular internal dimensions of the tundishes. Further, these plates can not be correctly applied to the surface of the permanent refractory layer, due to the uneveness of this surface. As a result, the plates become deformed under the pressure of the liquid metal, and as a result there is a risk of the deterioration of these plates, with as a result direct access of the liquid metal to the permanent refractory layer with all the disadvantages that implies.

In order to provide a partial remedy for these disadvantages, the plates have to be jointed with a refractory cement, which is a long and tedious process. In addition, such joints frequently give way, due to defects in the seating of these plates on the permanent refractory layer and to the tension resulting from the heat expansion of the plates when the liquid metal is introduced into the tundish.

In order to remedy the defect of the seating of the consumable plates on the permanent refractory layer, it is proposed to fill in the spaces between the latter and the consumable plates with a layer of non-binding refractory particles such as sand.

The use of such a sand layer does not avoid the tedious jointing of the plates and leads to a risk of the liquid metal becoming polluted by the sand if the refractory cement joints deteriorate or are defective.

Furthermore, the sand used, unless it is entirely dry, brings about on contact with the liquid metal, very strong deflagrations liable to bring about dangerous splashing of personnel standing close to the tundishes.

In addition, the fitting of the sand layer between the permanent lining and the consumable plate is particularly awkward. Furthermore, when at the end of the casting the tundish is turned upside down in order to remove the consumable plate, the sand layer, freed, brings about an unacceptable pollution.

A lining for metallurgical vessels consisting of a layer of ceramic fibres placed between a refractory lining and an exterior continuous layer, also refractory, is however known.

This highly compressible layer of fibres, consisting of fibres which are not bound together, is intended to absorb the force of the impact of the metal which is being cast in the vessel.

Bearing in mind the high degree of compressibility of such a layer of fibres, the latter provides a lining of only a very low heat insulation. Furthermore, the use of such a fibre layer is not compatible with the use of consumable plates joined between themselves by refractory cement. In fact, such joints would inevitably give way as the metal rises in the vessel. Furthermore, the fitting of such a fibre layer within the vessel is not easy.

The object of this invention is to provide a remedy for the above mentioned disadvantages by providing a lining for metallurgical vessels which is efficient, reliable, easy to fit and inexpensive.

The invention relates to a heat insulating lining consisting of a permanent layer in a refractory material and a consumable layer fitted within the vessel and intended to be in direct contact with the liquid metal, this layer consisting of a mixture of inorganic particles and organic and/or inorganic fibres embedded in an organic and/or inorganic binder.

According to the invention, the lining is characterised by the fact that between the permanent refractory layer and the above mentioned consumable layer there is a relatively compressible layer of an inorganic and/or organic fibre base resistant to temperature on contact with the above mentioned consumable layer, the fibres being partially embedded in an organic and/or inorganic binder and this layer being applied over virtually the totality of the area of the permanent layer.

This binder enables the compressibility of the fibre layer to be limited, whilst at the same time enabling the latter to compensate for all the uneveness in the surface of the permanent refractory layer. Furthermore, this layer relatively compressible under the effect of the pressure exerted by the metal, penetrates into the interstices between the consumable plates, thus forming truly liquid-tight joints. As a result any risk of the metal penetrating between the plates and of the correlative solidification of this metal on coming into contact with the permanent refractory layer is eliminated. Further, the long and tedious jointing of the plates with refractory cement is avoided.

In addition, it has been noted that the compressible and fibre layer appears considerably to improve the heat insulation of the walls of the metallurgical vessel, so that the liquid metal may be introduced into the vessel at a temperature appreciably below that used in known processes, which results in a substantial economy of energy.

Further, the fitting of such a compressible and fibrous layer, between the permanent refractory layer and the consumable layer is much easier than the introduction of a sand layer or the fitting of a non-bound fibre layer.

In accordance with an advantageous version of the invention, the compressible and fibrous layer contains approximately 10 to 30% in weight of binder, the compressibility of the layer being substantially between 5 and 10%, under a pressure of 10 Kg/cm$^2$.

With such a proportion of binder, spaces remain between the fibres and these are favourable to heat insulation, thus permitting a limited but sufficient compressibility of the fibrous layer, under the effect of the pressure of the liquid metal against the consumable plates.

In accordance with a preferred version of the invention, the compressible and fibrous layer includes, in addition, 0.5 to 20% in weight of refractory particles, with a flux added to bring about sintering of these particles at a temperature of between 1,100° C. and 1,500° C. These particles partially fill in the empty spaces between the fibres. When the liquid metal penetrates into the interstices of the plates, this metal finds its way between the fibres bringing about at least a partial decomposition of the organic fibres or of the organic binder. Thanks to the sintering of the refractory particles between themselves, these latter form a superficially vitrified layer which prevents the penetration of the metal into the compressible and fibrous layer.

To produce the lining of the present invention, there is applied to the permanent refractory layer a compressible fibre based layer, the external face of this compressible layer is covered with a layer of binder, after which there is applied to this layer of binder the plates of the consumable layer.

These plates are thus stuck to the compressible fibre layer by means of the binder layer.

The carrying out of this method is very easy and enables a particularly efficient lining to be obtained both with regard to its mechanical resistance and to its heat insulation.

In accordance with another version of the method the compressible fibrous layer is stuck to one of the faces of the plates of the consumable layer and the external face of this compressible and fibrous layer is placed against the permanent refractory layer.

A layer of binder may also be applied to the permanent refractory layer, before the compressible and fibrous layer is put into position.

Other details and advantages of the invention will appear in the following description.

Figure 6:
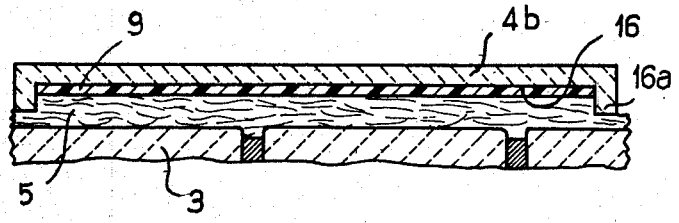
Figure 2:
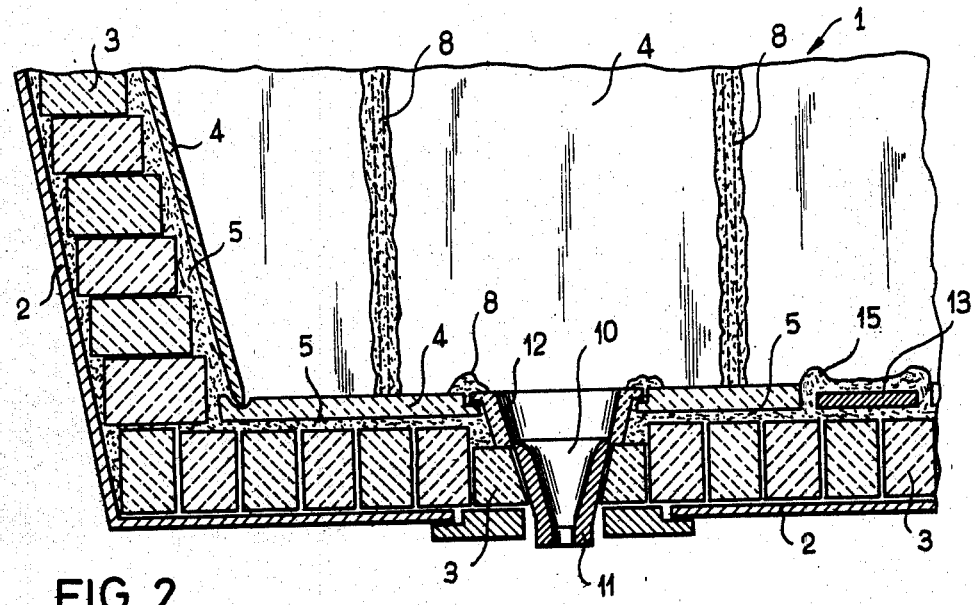
Figure 3:
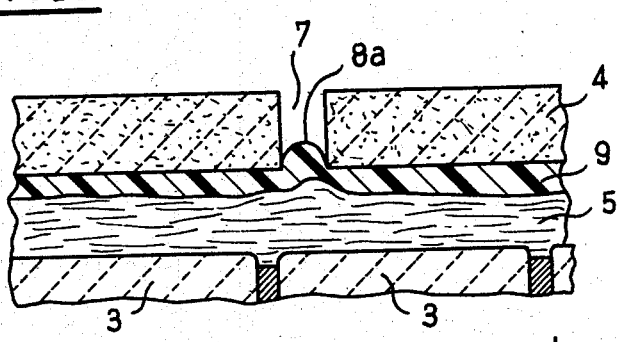
Figure 4:
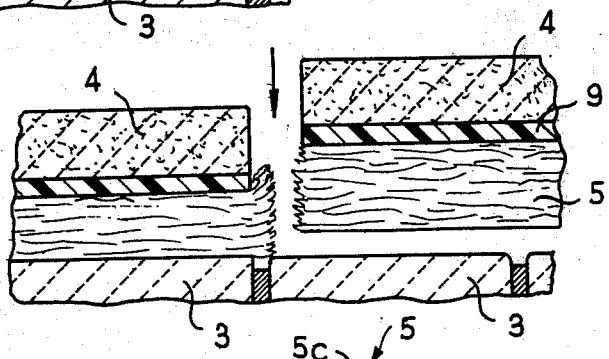
Figure 5:
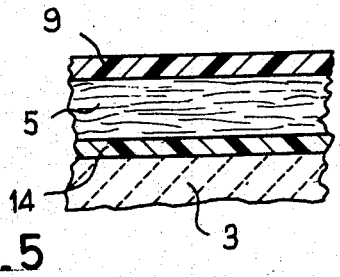
Figure 7:
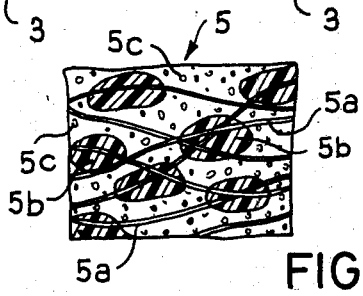

In the attached drawings, which are given by way of example without any limitation being implied:

FIG. 1 is a perspective view with a portion cut away of a tundish including a lining in conformity with the invention, FIG. 2 is a sectional view in the plane II—II of FIG. 1, FIG. 3 is a partial sectional view on a larger scale of a lining design in conformity with the invention, FIG. 4 is a view analogous to FIG. 3, showing another lining design and its fitting to a wall of a tundish, FIG. 5 is a view analogous to FIG. 3, showing a third version of the lining in conformity with the invention, FIG. 6 is a view analogous to FIG. 3 showing a fourth version of the lining in conformity with the invention, FIG. 7 is a sectional view on a large scale of a lining in conformity with the invention.

In the embodiment of FIGS. 1 and 2, the tundish includes an envelope 2 in steel lined on the inside with a permanent layer 3 in refractory bricks. This permanent layer 3 is itself covered by consumable and rigid plates 4 intended to be in direct contact with the liquid metal poured into the tundish 1. These consumable plates 4 cover the side walls as well as the bottom of the tundish 1.

The composition of the consumable plates 4 is known. These plates 4 are obtained, by example, by moulding, from a mixture of inorganic particles such as sand, and/or alumina and/or magnesium, with mineral fibres such as glass wool or slag, and/or vegetable fibres, animal or synthetic, added, the whole of these particles and fibres being completely embedded in an organic or inorganic binder. As inorganic binder, one may use for example a refractory cement and as organic binder a cheap phenolic type resin may, preferably, be used.

Between these consumable plates 4 and the permanent refractory layer 3, there is a relatively or semi-compressible layers 5 of a mineral and/or inorganic fibre base, resistant to the temperature in contact with the consumable plates 4. This layer 5 is applied over the whole of the area of the permanent layer 3.

The fibres of this layer 5 are partially embedded in an organic and/or inorganic binder.

In FIG. 7 it may be seen that the fibres 5*a* are locally bound to each other by the mass of the binder 5*b*, so that there are empty spaces between the fibres 5*a*. These spaces enable the layer 5 to be slightly compressible.

The plates 4 are applied by compression between the compressible fibrous layer 5, by means of hooks 6 which cover the upper edge 4*a* of the plates 4, and the upper edge 3*a* of the permanent refractory layer 3, thus pressing the plates 4 against the refractory layer 3.

As a result of this compression, the compressible and fibrous layer 5 forms, between the interstices 7 between the plates 4, pads 8 which constitute truly watertight joints.

The fibres making up the compressible layer 5 may be, for example, of glass wool or of slag, or of ceramic fibres. Such fibres resist well the temperature of the consumable plates 4. Taking into account the heat insulation provided by these inorganic fibres, the latter may be partially mixed with synthetic organic vegetable or animal fibres, resisting without appreciable decomposition temperatures of the order of 150° to 200° C. These organic fibres enable the heat insulation of the layer 5 at relatively low temperatures to be improved, that is to say at the temperatures resulting from the heat exchange with the exterior of the tundish. The density of the fibres in their non-compressed state is between 0.4 and 0.8.

In order to allow for a certain degree of compressibility of the layer 5, this latter includes 10 to 30% in weight of binder. Depending on the proportion of binder, the nature of the binder and of the fibres, a compressibility of the layer 5 is obtained which is between 5 and 10% of its thickness, under a pressure of 10 Kg/cm$^2$, this pressure corresponding to the pressure exerted by the metal on the plates 4, when a normally dimensioned tundish is completely filled with metal.

Preferably, the fibrous layer 5 includes, in addition, 0.5 to 20% of weight of refractory particles with an added flux in order to obtain sintering of these particles at a temperature of between 1,100° C. and 1,500° C.

In FIG. 7, it will be seen that these refractory particles 5*c* are to be found between the empty spaces between the fibres 5*a* and the mass of binder 5*b*.

As refractory particles 5c, there may be used, for example, sand, alumina, magnesia, diatomaceous earth, ashes of rice husks, and a mixture of these particles in a finely divided state so as to obtain as homogeneous a mixture as possible of these particles within the layer 5.

As flux, boro-calcium, iron oxide, carbonate of soda may be used depending on the sintering temperature which it is wished to obtain.

The proportion of flux may vary between 0.5 and 20% of weight of the refractory particles depending on the nature of the latter and the sintering temperature which it is wished to obtain.

In the case of ferrous metals (cast irons or steels) the nature of the refractory particles and of the fluxes is chosen so as to obtain sintering at a temperature approximately between 1,100° C. and 1,500° C.

When the liquid metal penetrates into the interstices 7 between the plates 4, the metal filters between the fibres 5a situated on the exterior of layer 5, thus bringing about a partial decomposition of the organic fibres and of the organic binder 5b. On contact with the refractory particles 5c, the latter sinter and weld together forming, vertically above the interstices 7 of the plates 4, a superficially vitrified layer which acts as a barrier to the advance of the metal. The heat insulation and the mechanical resistance of the layer 5 are thus entirely preserved during the casting operation.

The fibrous and semi-compressible layer 5 may also include 1 to 10% in weight of a triglyceride oil such as soybean oil, in order to avoid absorption of humidity by this layer 5.

In the example of FIG. 3, the compressible and fibrous layer 5 is covered, on its face which is in contact with the consumable plates 4, by a layer 9 of an organic or inorganic binder. This binder layer 9 has partially embedded in it the inorganic and/or organic fibres of the compressible and fibrous layer 5. This binder layer 9 thus ensures the cohesion of the fibres of the compressible layer 5, without affecting the compressibility of this latter.

The binder of the layer 9 may be refractory cement, or a phosphoric binder, or a silicate of soda or even of an ordinary Portland type cement. The binder of the layer 9 may, nevertheless, consist of a synthetic resin such as a phenolic resin. Such a resin does not resist permanently the temperature obtaining at the back of the plates 4. This resistance is nevertheless sufficient in the majority of cases, given that the liquid metal remains for only relatively short periods in the tundish 1, so that the temperature at the back of the plates 4 does not generally exceed 250° to 300° C. An organic binder has the advantage of being easy to apply, of not appreciably altering the flexibility of the fibrous layer 5, and of conferring on this latter a high heat insulation coefficient.

In the design shown in FIG. 3 the binder layer 9 also adheres to the consumable plates 4, in such a way that these plates 4 become an integral part of the compressible fibrous layer 5.

Thus, during casting, the plates 4 do not risk being displaced in relation to the compressible and fibrous layer, so that all risks of the liquid metal infiltrating behind the consumable plates 4 is eliminated.

Preferably, the binder layer 9 should include inorganic particles sintering at the temperature obtaining in the interstices 7 between the plates 4, when the liquid metal reaches these interstices.

These inorganic particles may consist of a mixture of silica grains and/or alumina finely crushed and with a flux added in order to obtain a partial melting of these inorganic particles at the temperature of the liquid metal which has reached the aforesaid interstices 7.

This partial melting of the inorganic particles brings about a welding of the particles between themselves. This welding ensures the cohesion of the binder layer 9, even if the organic binder used is partially decomposed. The flux used may consist of boro-calcium, iron oxide or of carbonate of soda, depending on the melting temperature which one wishes to obtain.

The proportion of inorganic particles contained in the binder layer 9 may vary between 50 and 90% in weight of this layer 9.

The thickness of the binder layer 9 will generally be less than one-half of the thickness of the compressible fibrous layer 5, so that the latter may remain compressible over a sufficient proportion of its thickness.

The thickness of the compressible and fibrous layer 5 is generally between 3 and 10 centimeters and is determined in accordance with, on the one hand, the degree of heat insulation required and, on the other hand, the uneveness of the underlying refractory layer 3 which it is necessary to compensate for.

Thanks to the heat insulation provided by the compressible and fibrous layer 5, the consumable plates 4 may be thinner than those used in known designs. Furthermore, bearing in mind the presence of the compressible and fibrous layer 5 behind the consumable plates 4, it is no longer necessary for the dimensions of the latter to be perfectly adapted to those of the tundish 1 in order to obtain a perfect joint between these plates 4.

In particular, thanks to the invention, it is generally unnecessary to effect shoulders on the edges of the plates 4, in order to obtain overlapping joints.

Thanks to the compressible and fibrous layer 5, it is possible to slightly superimpose the adjacent edges of the plates 4. Thus, the fitting of the latter within the tundish may be carried out very rapidly, without any prior adjustment to the dimensions of these plates 4.

In the embodiment of FIGS. 1 and 2, the tundish 1 has a pouring hole 10 which reaches the outside by means of a nozzle 11 in a refractory material. This pouring hole 10 is fitted, above the nozzle 11, with a ring 12, in a material comparable to that of the consumable plates 4. In FIG. 2 it will be seen, that the compressible fibrous layer 5 fills the space between this consumable ring 12 and the permanent refractory layer 3 adjacent to the pouring hole 10. The compressible and fibrous layer 5 ensures, in relation to the ring 12, the same functions as it does with regard to the plates 4.

In the zone of impact of the casting jet of the liquid metal into the tundish 1, is fitted a plate 13 in steel or in a refractory material of high resistance to abrasion such as zirconia or silicon carbide.

The compressible and fibrous layer 5 has the effect, quite apart from its heat insulation role, of absorbing the force of the impact of the jet of liquid metal thus protecting the permanent refractory layer 3.

We are now going to describe the method for the realisation of the heat insulating lining in conformity with the invention.

This method may be carried out in a number of ways.

In a first version of the method, the compressible and fibrous layer 5 is applied directly to the permanent refractory layer 3. Subsequently there is applied to this fibrous layer 5 the binder layer 9. The latter, depending on the nature of the binder, may be effected by projection, spraying, coating, moulding or similar methods. In this operation, a quantity of binder just sufficient to cover the fibre layer over a part of its thickness is used.

The binder of the layer 9 thus obtained may then be left to harden.

Nevertheless, and preferably, the consumable plates 4 are applied directly to the non-hardened binder of layer 9, so as to obtain an adhesion between these plates 4 and the binder layer 9.

The application of the layer 5 to the prefabricated plates 4 is effected, preferably, by spraying of a mixture of fibres, binder and refractory particles. In this method of application the coating of the plates 4 with a binder is optional.

The spraying of the above mentioned mixture is effected, preferably, by means of a gun into which is introduced the previously separated fibres, the refractory particles and the binder as a dry powder. The liquid to be used for forming the binder (water—in the case of an inorganic binder, solvent—in the case of an organic binder) is introduced radially at the gun outlet by means of an annular chamber.

In this way, the mixture of the constituents of the layer 5 is applied in a very homogeneous manner over the plates 4, direct adherence being obtained thanks to the binder.

After the fitting of the plates 4 lined with the fibrous layer 5, the hooks 6 for holding the plates 4 are fitted. The fitting of these hooks 6 has the effect of compressing the compressible fibrous layer 5 against the underlying refractory layer 3. This compression brings about the formation within the interstices 7, between the plates 4, of pads 8*a* forming truly liquid-tight joints.

Thanks to these liquid-tight pads 8*a*, the long and tedious operation of jointing the interstices 7 between the plates 4 by means of a refractory or similar cement is avoided.

The tundish 1 is then ready to receive the liquid metal. Thanks to the additional heat insulation provided by the compressible fibrous layer 5 the metal may be introduced at a temperature lower than that usually practised which achieves an appreciable saving of energy.

In addition, the metal does not risk infiltrating behind the plates 4 due to the formation of the liquid-tight pads 8*a*.

At the end of casting, that is to say when the tundish is empty, the cleaning of the latter is very easy. It suffices, in fact, to withdraw the hooks 6 and then to turn the tundish upside down which immediately brings about the detaching of the consumable plates 4 and of the compressible and fibrous layer 5. This latter may, if necessary, be re-used, where necessary after replacement of the binder layer 9.

In another version of the method in conformity with the invention, there is stuck first of all to the back of the consumable plates 4, a compressible and fibrous layer 5 adapted to the dimensions of the plates 4 and previously coated with the binder layer 9. The consumable plates 4 thus lined are then placed against the permanent refractory layer 3, as indicated in FIG. 4. The elements of the lining consisting of the plates 4 adhering to the compressible and fibrous layer 5 may be prefabricated and stored a long time in advance.

After fitting of the hooks 6 the compressible and fibrous layers 5 connected to the various plates 4 are compressed and form, at the interstices 7 of the various plates, liquid-tight pads as in the case of the previous version of the method.

As a variant, which may be applied to either of the two above mentioned versions of the method the permanent refractory layer 3 may previously be coated with a binder layer 14 (see FIG. 5).

Such a binder layer 14 facilitates the fitting of the compressible and fibrous layer 5, particularly in the case of the first version of the method.

This binder layer 14 may be discontinuous, that is to say applied only in places, on the permanent refractory layer 3.

The binder of the layer 14 is, preferably, organic and decomposable at the heat obtaining at the permanent refractory layer 3. In fact, this decomposition eliminates, at the end of casting, any adherence of the compressible and fibrous layer 5, which facilitates the removal of the latter.

Of course, the invention is not limited to the examples which have just been described, and these may be modified in a number of ways without going outside the framework of the invention.

Thus, the lining which is in conformity with the invention may also be applied to casting ladles or to other metallurgical vessels intended to contain ferrous or other metals.

The hooks for holding the consumable plates 4 may be replaced by any other method of fixing such as props arranged transversely to the vessels and being supported against the facing plates applied against the opposite side walls of the vessel.

Of course, the sheet of fibres used for making the compressible layer 5 may be held together, beforehand, on one of its faces by a leaf, of paper for instance, in order to facilitate the handling of the fibres.

Furthermore, the thickness of the compressible and fibrous layer 5 may decrease in the direction of the height of the vessel.

The impact plate 13 may also be covered with a compressible and fibrous layer 15 (see FIGS. 1 and 2) of the same nature as the layer 5.

This layer 15 may be shaped like a dish, thanks to the binder which partially covers the fibres. This layer 15 re-inforces the absorbing of the metal jet, procured by the layer 5 fitted between the impact plate 13 and the refractory bricks 3.

On the other hand, the consumable plates 4, instead of being perfectly flat, may have on their face which is in contact with the fibrous compressible layer 5 a hollow as designated by reference 16 on the plate 4*b* shown in FIG. 6. In this figure, the hollow 16 extends over virtually the whole of the length and the width of the plate 4*b*. In this hollow 16 is stuck, by means of a binder layer 9 the compressible and fibrous layer 5. The latter overlaps on each side the plate 4*b*. This hollow 16 facilitates handling and storage of the plates 4*b* fitted with the compressible and fibrous layer 5. Furthermore, the outside border 16*a* of these plates 4*b* limits the compression of the fibrous layer 5 and facilitates the application of this layer by projection. Naturally, the removable consumable plates and/or the permanent lining in bricks may be replaced by a continuous heat insulating and/or refractory layer obtained for example by projection in order to create a lining formed in situ directly on the wall of the metallurgical vessel.

What we claim is:

1. In a heat insulating lining for metallurgical vessels intended to contain liquid metal, comprising a permanent layer in a refractory material and a consumable layer to be fitted to the interior of the vessel and intended to be in direct contact with the liquid metal, said consumable layer comprising a plurality of plates made of a mixture of inorganic particles and of fibers, said particles and fibers being embedded in a binder; the improvement comprising, between the above-mentioned permanent and consumable layers, a compressible layer of fibers resistant to the temperature obtaining at the interface between said compressible layer and said consumable layer, the last-named fibers being partially embedded in a binder, the amount of binder being about 10 to 30% by weight of the said compressible layer in order to impart to said compressible layer a compressibility between about 5 and 10% under a pressure of 10 kg/cm$^2$ applied on said compressible layer, and said compressible layer covering substantially the whole surface of the permanent layer.

2. A lining as claimed in claim 1, the compressible and fibrous layer includes, in addition, 0.5 to 20% by weight of refractory particles with an added flux in order to obtain sintering of these particles at a temperature between 1,100° C. and 1,500° C.

3. A lining as claimed in claim 1, in which the compressible and fibrous layer includes, in addition, 1 to 10% by weight of a triglyceride oil.

4. A lining as claimed in claim 1, said compressible layer having on its face intended to come in contact with the consumable layer, a layer of a binder, said layer covering at least partially said compressible layer.

5. A lining as claimed in claim 4, in which the binder layer adheres to the consumable layer.

6. A lining as claimed in claim 4, in which a binder layer is also applied to the face of the compressible and fibrous layer facing the permanent refractory layer.

7. A lining as claimed in claim 1, and a pouring hole lined on the interior with a layer of the same material as that of the consumable plates which cover the interior of the vessel, and a compressible layer of fiber between the refractory wall of the pouring hole and said consumable layer.

8. A lining as claimed in claim 1, in which the zone of impact of the jet of liquid metal poured into the vessel is covered by a protective plate in a material resistant to erosion, and a compressible layer of fibers between said protective plate and the permanent refractory layer of the lining.

9. A lining as claimed in claim 1, in which the inside face of the consumable plates has a hollow in which is lodged the compressible and fibrous layer, this last-named layer overlapping on either side of the consumable plates.

* * * * *